United States Patent [19]

Hellwig

[11] Patent Number: 4,580,915

[45] Date of Patent: Apr. 8, 1986

[54] SINGLE SHAFT SHEET ADVANCEMENT MECHANISM

[76] Inventor: Eberhard R. Hellwig, 6 Indian Hill Rd., Rye, N.Y. 10580

[21] Appl. No.: 678,904

[22] Filed: Dec. 6, 1984

[51] Int. Cl.[4] ..... B41J 29/00

[52] U.S. Cl. ..... 400/718.2; 400/718

[58] Field of Search ..... 400/58, 718, 718.1, 400/718.2

[56] References Cited

U.S. PATENT DOCUMENTS

| | | | |
|---|---|---|---|
| 999,181 | 12/1913 | Peetz et al. | 400/718.2 |
| 1,499,582 | 7/1924 | Laguionie | 400/718 |
| 1,573,237 | 2/1926 | Forney | 400/718 X |
| 1,730,445 | 10/1929 | Barney | 400/541 |
| 1,758,657 | 5/3930 | Pensky et al. | 400/718.1 |
| 1,765,306 | 6/1930 | Harris | 400/718 |
| 2,006,609 | 7/1935 | Streeter | 40/348 |
| 2,029,074 | 1/1936 | Hyatt | 400/183 |
| 2,273,388 | 2/1942 | Stevens | 40/346 |
| 2,617,386 | 11/1952 | Kao | 40/343 |
| 2,633,828 | 4/1953 | Adkins et al. | 226/133 |
| 2,949,886 | 8/1960 | Tibbling | 40/343 |
| 3,003,467 | 10/1961 | Berry | 40/347 |
| 3,030,923 | 4/1962 | Abseck et al. | 40/343 |
| 4,043,064 | 8/1977 | Friedman | 40/343 |
| 4,076,112 | 2/1978 | Effinger | 400/552 |

FOREIGN PATENT DOCUMENTS

| | | | |
|---|---|---|---|
| 1260658 | 4/1961 | France | 400/718 |

OTHER PUBLICATIONS

IBM Technical Disclosure Bulletin, "Spring Loaded Round Platen" by Bratton et al., vol. 26 No. 4, 9–83, p. 1834–1835.

*Primary Examiner*—Edgar S. Burr
*Assistant Examiner*—John A. Weresh
*Attorney, Agent, or Firm*—Henderson & Sturm

[57] ABSTRACT

A copysheet incremental feeder apparatus (10) comprising a drive unit (11) operatively connected to a rotor actuating unit (12) which drives a "floating" roller unit (13) rotatably disposed in a roller housing unit (14), whereby the floating roller element (27) produces a positive friction drive on the copysheet (100), regardless of the vertical disposition of the roller unit (13) within the housing (14).

3 Claims, 7 Drawing Figures

SINGLE SHAFT SHEET ADVANCEMENT MECHANISM

TECHNICAL FIELD

This invention relates generally to the field of sheet advancement mechanisms, and more specifically to a copyholder sheet advancement mechanism for use by keyboard operators.

BACKGROUND ART

This invention was the subject matter of Patent Office Disclosure Document No. 124,653 filed Mar. 21, 1984.

Numerous attempts have been made in the past to develop a desk top or typewriter attached copyholder sheet advancement mechanism that is simple, efficient, quiet, compact and reliable.

Most of the prior art mechanisms that have been developed share common structural features such as a ratcher or pawl advancement mechanism and a plurality of drive rollers in the form of a feed roller and a pressure roller used to frictionally engage and incrementally advance a sheet of paper placed in the mechanism.

In addition, the prior art mechanisms range from the extremely simple structures to the extremely complex structures, and they may further be manually or automatically controlled and driven either electrically, mechanically, or pneumatically.

Some representative examples of the myriad aforementioned prior art mechanisms my be seen by reference to the following U.S. Pat. Nos.: 2,949,886; 1,730,445; 3,030,923; 2,006,609; 2,273,388; 2,633,828; and 3,003,467. A quick review of these listed patents will make it abundantly clear how different are the end products of the various approaches to this problem.

It should also be apparent that this wealth of prior art is directly attributable to the fact that a perfect or near perfect solution to the copyholder feeding problems has up until the present time been lacking.

DISCLOSURE OF THE INVENTION

Most, if not all, of the problems, inferred above, are substantially resolved by the provisions of the instant invention. The instant invention comprises in general a remote drive unit, a rotor actuating unit, a roller unit, and a roller housing unit.

The drive unit per se is not considered an integral part of this invention and may comprise either an electrical, mechanical, or pneumatic drive mechanism or a drive mechanism that combines features from the various drives. For the purposes of this invention, any suitable drive mechanism will suffice, as long as it is capable of transmitting force to a remote location.

The rotor actuating unit is operatively connected to the drive mechanism and comprises a pawl and ratchet arrangement, which incrementally advances the roller unit in a well recognized fashion.

The roller unit comprises a free floating roller assembly wherein the roller element is vertically displaceable with respect to the roller housing member so that the full weight of the roller element is transmitted to the sheet of paper.

The roller housing unit comprises a clear acrylic housing member having an arcuate interior and provisions for receiving the roller unit, and the actuating unit. In addition the housing member is further provided with a lateral paper guide element that insures the proper orientation of the sheet, as it is transported through the combined apparatus.

The roller housing unit also comprises, mounting means in the form of variously configured end plates that will allow the roller housing unit to be mounted directly above an alphanumeric keyboard, such as is found on a typewriter, telex machine, typeset machine, computer or the like.

With the apparatus mounted above the keyboard and the remote drive unit operatively connected to the rotor actuating unit, the apparatus is ready for use; the operator simply feeds the copysheet downwardly into the roller housing, and the longitudinal stiffness of the sheet will lift the free floating roller out of engagement with the interior wall of the roller housing to frictionally engage the copysheet between the roller and the housing wall. The drive unit is then selectively actuated to cause the incremental advance of the copysheet through the apparatus at a speed determined by the requirements of the operator.

It should further be appreciated that the ratchet and pawl stepping assembly produces a positive paper drive in one direction; and when the ratchet is released at the top of the actuating stroke, returns to its starting position for the next incremental advance of the copysheet.

BRIEF DESCRIPTION OF THE DRAWINGS

These and other attributes and novel features of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
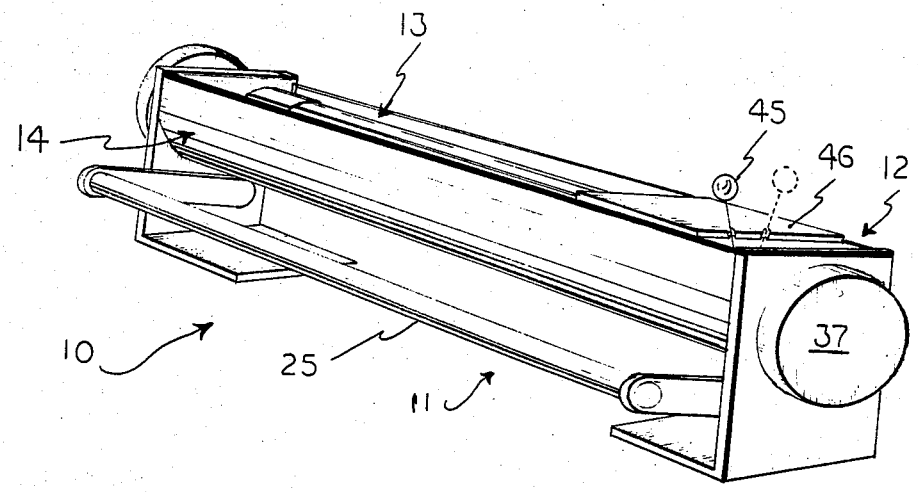
FIG. 1 is a perspective view of one form of the preferred embodiment.
Figure 2:
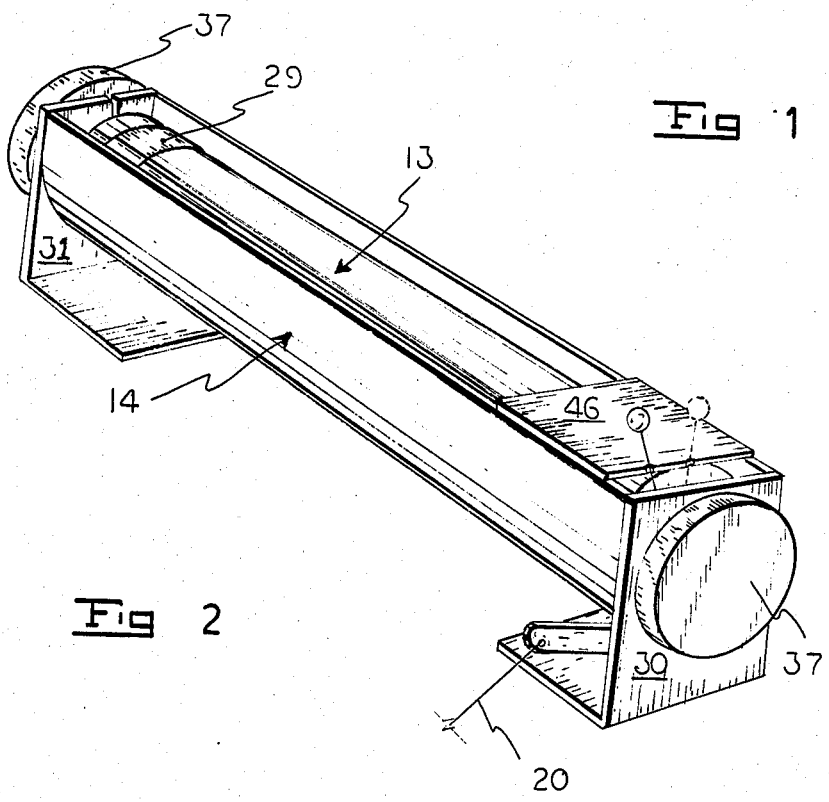
FIG. 2 is a perspective view of another form of the preferred embodiment.
Figure 3:
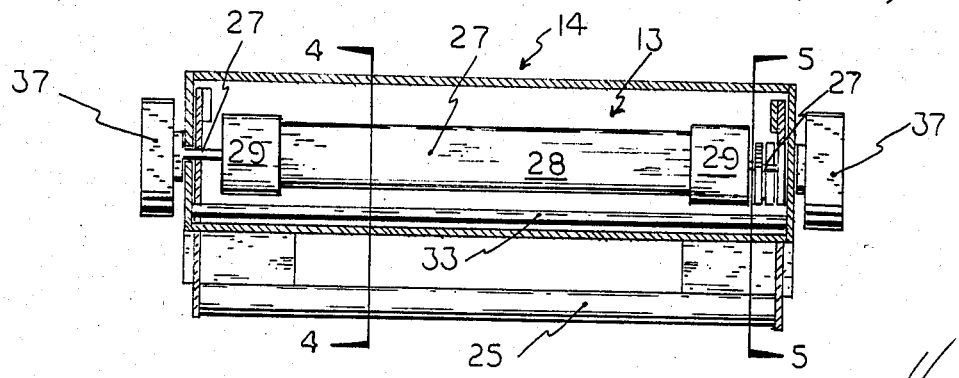
FIG. 3 is a top detail view of the roller housing.

Referring now to the drawings, and in particular to FIG. 1, the apparatus may be seen as depicted generally by the numeral (10). The apparatus (10) includes generally a remote drive unit (11), a rotor actuating unit (12), a roller unit (13) and a roller housing unit (14). Each of these units will now be described in seriatim fashion.

As mentioned earlier in the specification, this invention may be practiced using a direct drive unit, or any one of a variety of remote drive units (11), and the invention should not be limited to the particular drive unit (11) illustrated in the drawings. It should be noted, however, that the drive unit, illustrated in the drawings contains unique structural features, that represent an advancement over the prior art drive units.

Figure 6:
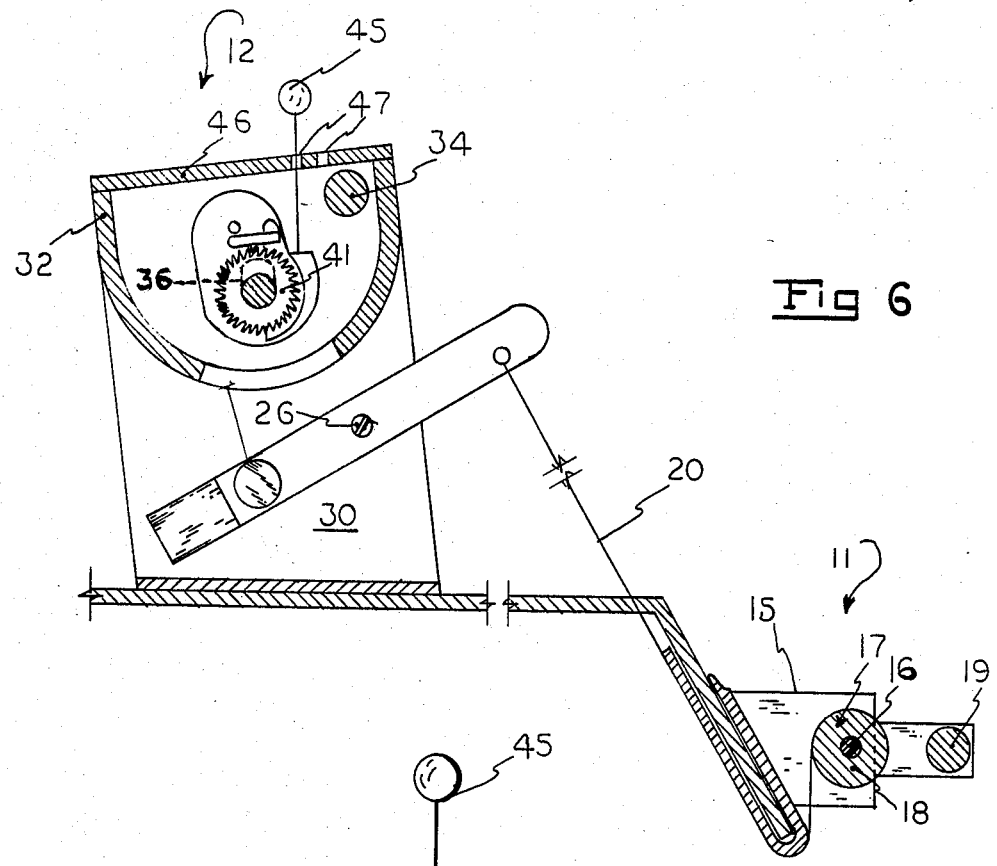
FIG. 6 is a detail view of the rotor actuating and drive units.

As can be seen by reference to FIG. 6, the drive unit (11) of the preferred embodiment comprises in general a support housing (15) having an axle member (16) which rotatably supports a drive element (17). The drive element (17) further comprises a cylindrical member (18) having a drive bar (19) projecting radially outwardly therefrom, in a generally horizontal disposition.

The drive unit (11) is operatively connected to the rotor actuator unit (12) via an elongated filament (20) that is stretched between the respective units. The filament (20) in the preferred embodiment comprises a length of monofilament or the like, wherein the force applied to the drive bar (19) is transmitted via the filament (20) to the rotor actuator unit (12).

Figure 5:
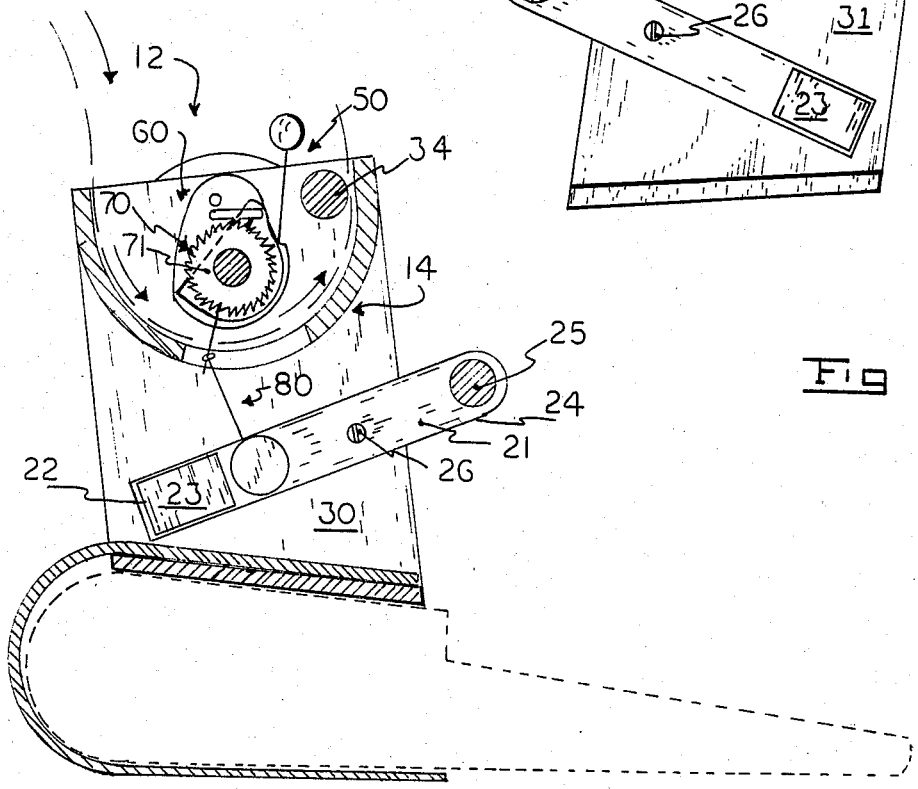
FIG. 5 is a detail view of the rotor and pawl assembly.

As can best be seen by reference to FIGS. 5 and 6, the rotator actuating unit (12) comprises in general an elongated actuator member (21) pivotally secured proximate its mid-point to the roller housing unit (14). The outboard end (22) of the actuator member (21) is provided with a weighted element (23) to bias the outboard end (22) in a downward direction; and the inboard end (24) of the actuator member is provided with an actuator force receiving means (25).

In the version of the preferred embodiment illustrated in FIG. 5, the actuator force receiving means (25) comprises an elongated bar (25') that is horizontally disposed across the roller housing unit (14); and in this instance the elongated bar (25') functions as the drive unit (11), inasmuch as the drive force is intended to be applied directly to the elongated bar (25') to rotate the actuator member (21) about the pivot (26) to the rotor actuating unit (12).

The aforementioned force transmittal to the rotor actuating unit (12) is accomplished through a resilient drive means (80) whose purpose, function, and construction, will be explained in detail further on in the specification.

The roller unit (13) comprises in general a roller member (27) having elongated axles (27') formed on its ends. The roller member (27) is rotatably disposed in the roller housing unit (14), and has a main body element (28) formed from a length of clear acrylic rod stock. In addition, the main body element (28) is further provided with a plurality of sleeve members (29) that act as the friction surface that will actually drive the copysheet through the apparatus (10).

Figure 4:
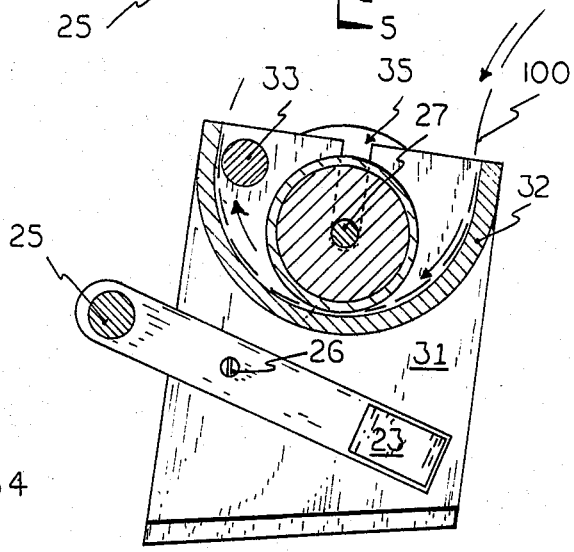
FIG. 4 is a cross-sectional view of the roller housing taken through line 4—4 of FIG. 3.

The roller housing unit (14) comprises two vertically upstanding end plate members (30) connected at their upper ends by a semi-circular acrylic trough element (32), which defines the lower portion of the paper path. The trough element (32) is further provided with an elongated paper guide element (33) disposed proximate to, but spaced from the inboard end of the trough element (32). As shown in FIGS. 4 and 5, the paper guide element (33) comprises an elongated acrylic rod member (34) which extends between the end plate members (30) and (31).

As shown in FIG. 4, end plate member (31) is provided with an elongated slot (35) that is dimensioned to receive and support one of the roller axles (27'); and, as shown in FIG. 6, end plate member (30) is provided with a generally elliptical aperture (36) shown in phanton that is dimensioned to allow limited vertical translation of the other roller axle (27') therein. This arrangement provides a "floating" support system for the roller member (27) within the roller housing unit (14). In addition, each of the roller axles (27') are provided with knob elements (37) on their outboard ends, to provide manual rotation of the roller member (27) when desired.

Figure 7:
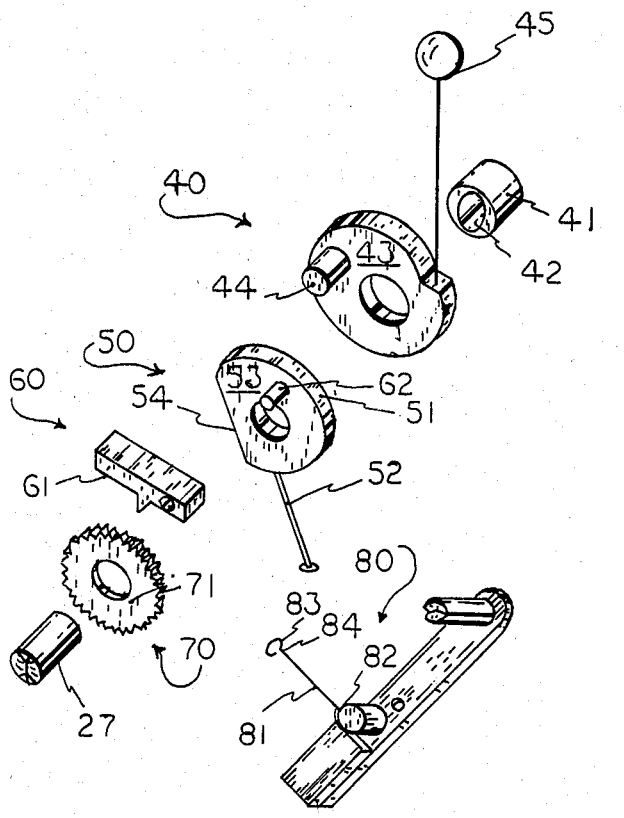
FIG. 7 is an exploded perspective view of the rotor actuating and drive units.

Turning now to FIG. 7, it can be seen that the rotor actuating unit (12), comprises a rotor assembly (50), and a pawl assembly (60) which are operatively connected to one another and to one of the roller axles (27') via a ratchet element (70) such as ratchet gear (71).

The indexer assembly (40) comprises an axle element (41) rigidly secured to end plate member (30) and having an elongated aperture (42) that coincides with the generally eliptical aperture (36) in end plate member (30). The indexer assembly (40) also comprises an indexer member (43) rotatably disposed on the axle element (41) and provided with a stop element (44) and an indexer lever (45) is disposed generally perpendicular to the roller axle. (27').

The final component of the indexer assembly (40) comprises an indexing plate (46), disposed across the trough element (32) of the roller housing unit (14), and provided with a plurality of notches (47) that are dimensioned to receive the indexer lever (45), to vary the position of the stop element (44) within the roller housing unit (14).

The rotor assembly (50) comprises a contoured rotor cam element (51), rotatably disposed on the roller axle (27') and provided with an elongated force transmitting element (52) projecting downwardly therefrom and operatively engaging the resilient drive means (80) mentioned supra. The contoured rotor cam element (51) having a generally flat edge (54) that is adapted to contact the stop element (44) on the indexer member (43) to limit the rotary motion of the cam element (51) on the roller axle (27').

The pawl assembly (60) comprises a toothed pawl element (61) pivotally secured to the upper portion (53) of the cam element (51) via a pivot element (62). The toothed pawl element (61) is adapted to operatively engage the ratchet element (70) which is rigidly attached to the roller axle (27'), to impart rotation to the roller member (27) in one direction only. When the toothed pawl element (61) moves in the counter-clockwise direction, as seen in FIG. 5, the roller member (27) has rotary movement imparted thereto. However, when the toothed pawl element (61) moves in the clockwise direction, no rotary movement is imparted to the roller member.

Turning again to FIG. 7, the resilient drive means (80) comprises an elongated spring wire element (81) having one end (82) affixed to the actuator member (21) and having a loop (83) formed on its other end (84). The loop (83) of the resilient drive means (80) slidingly engages the force transmitting element (52) of the rotor assembly (50) to impart rotary motion thereto.

It should be appreciated at this point that force exerted on the drive unit (11) will be transmitted through the rotor actuating unit (12) to impart rotary movement to the roller unit (13). In addition, the roller axis members (27') are suspended in a "floating" relationship with respect to the roller housing unit (14), to permit the vertical translation of the roller member (27) therein, to accommodate copysheets (100) of different thickness within the apparatus (10).

It should also be appreciated at this juncture that the end plate members can be given different configurations that can be custom designed for attachment of the end plate members to any type of a device having an alpha numeris keyboard, and the present invention should not be limited to the particular structures illustrated and described herein.

The operation of the apparatus (10) proceeds as follows:

After the apparatus has been installed in its desired location on (or adjacent to) a keyboard, the keyboard operator takes the copy sheet in a reversed and inverted position, and forces the lower leading edge of the copysheet downwardly against the outboard edge of the roller member (27). The inherent longitudinal stiffness of the copysheet being of a sufficient magnitude to raise the "floating" roller upwardly out of engagement with the roller trough. Once the copy sheet has been interposed between the roller member and the roller trough, one or both of the axle knobs (37) may be rotated to feed the copysheet in a counter-clockwise direction. Since the leading edge of the copysheet is being engaged by the friction collars on the roller member that portion of the copysheet will retain the longitudinal stiffness to track the interior of the roller trough and thread itself between the paper guide and the forward end of the roller trough. When the copysheet has been advanced in this manner, to the point that the keyboard operator desires, the drive unit can be selectively actuated to incrementally advance the copysheet at whatever speed they require.

Several features of this invention should be stressed at this point. The first of these is that virtually the entire apparatus can be fabricated with clear acrylic components, with the exception of the wire spring and the optional monofilament force transmitter. This type of construction produces an aesthetically pleasing arrangement that is virtually static free.

However, the most important feature of this invention resides in the "floating" suspension of the roller member (27) within the roller housing (14); as well as the construction of drive unit (12), which has been specifically designed to insure a positive engagement of the toothed pawl element (61) with the ratchet element (71) regardless of the vertical displacement of the roller member (27) within the housing (14).

Obviously, many modifications and variations of the present invention are possible in light of the above teachings. It is therefore to be understood that, within the scope of the appended claims, the invention may be practiced otherwise than as specifically described.

What I claim is:

1. A single sheet advancement apparatus in combination with an alpha-numeric keyboard wherein the apparatus is used to incrementally advance a copysheet so that the copysheet may be visually scanned by the operator of the keyboard; and, wherein the apparatus consists of:

a roller unit consisting of a single elongated roller member having roller axles projecting from both ends, and friction sleeve elements disposed proximate the ends;

a transparent roller housing unit comprising: a clear acrylic roller through having an elongated semicircular configuration; a pair of vertically disposed end plate members connected to said roller through wherein one of said end plate members is provided with an elongated slot that is dimensioned to receive one of said roller axles, whereby said roller housing unit supports said roller member in a floating relationship to accommodate copysheets of different thickness intermediate said roller housing unit and said roller unit;

an actuator unit operatively associated with said roller unit and comprising: an indexer assembly; a rotor assembly; and, a pawl assembly connected to one another and to one of the roller axles via a ratchet element, wherein the actuator unit further comprises an elongated actuator member mounted on a pivot element disposed proximate its midpoint and secured to the roller housing unit, wherein the actuator unit is operatively connected to a drive unit via a drive means attached on one end to said pivot element, wherein the drive means has a loop formed on its other end which slidingly engages an elongated force transmitting element disposed on said rotor assembly, wherein said drive unit is operatively associated with said actuator unit for transmitting incremental rotary movement to said roller unit; and, the said indexer assembly comprises: an axle element secured to one of the end plate members; an indexer member rotatably disposed on the axle element, and provided with a stop element; an indexer lever that is disposed generally perpendicular to the roller axle; and, an indexing plate connected to the roller housing unit and provided with a plurality of notches that are dimensioned to receive said indexing lever to vary the position of said stop element within the roller housing unit.

2. An apparatus as in claim 1; wherein, said rotor assembly comprises:

a contoured rotor cam element, rotatably disposed on a roller axle and provided with an elongated force transmitting element projecting downwardly therefrom, and having a generally flat edge that contacts said stop element on the indexer member to limit the rotary motion of the cam element on the roller axle.

3. An apparatus as in claim 2; wherein, the pawl assembly comprises:

a toothed pawl element pivotally secured to the upper portion of the cam element via a pivot element, wherein the toothed pawl element is disposed to engage the said ratchet element which is rigidly attached to one of the roller axles to impart rotation to the roller member in one direction only.

* * * * *